US006846063B2

(12) United States Patent
Spitz et al.

(10) Patent No.: US 6,846,063 B2
(45) Date of Patent: Jan. 25, 2005

(54) CHIMNEY FOR PREVENTING INK MISTING

(75) Inventors: Donald Norman Spitz, Lexington, KY (US); Ryan Timothy Ward, Lexington, KY (US); Yu-Feng Huang, Chiai (TW); Nai-Hsiang Ma, Tainan (TW)

(73) Assignee: Lexmark International, Inc., Lexington, KY (US)

( * ) Notice: Subject to any disclaimer, the term of this patent is extended or adjusted under 35 U.S.C. 154(b) by 4 days.

(21) Appl. No.: 10/023,294

(22) Filed: Dec. 17, 2001

(65) Prior Publication Data

US 2003/0112290 A1 Jun. 19, 2003

(51) Int. Cl.[7] ..... B41J 2/165; B41J 2/015

(52) U.S. Cl. ..... 347/36; 347/29; 347/34; 347/30; 347/33

(58) Field of Search ..... 347/20, 21, 36, 347/29, 34, 30, 33; B41J 2/165, 2/015

(56) References Cited

U.S. PATENT DOCUMENTS 4,853,717 A * 8/1989 Harmon et al. ..... 347/29
4,920,362 A 4/1990 Cowger ..... 346/140
4,961,076 A 10/1990 Cowger ..... 346/1.1
5,027,134 A * 6/1991 Harmon et al. ..... 347/29
5,103,243 A 4/1992 Cowger ..... 346/1.1
5,440,331 A * 8/1995 Grange ..... 347/32
5,455,608 A * 10/1995 Stewart et al. ..... 347/23
5,497,178 A 3/1996 DeFosse et al. ..... 347/87
5,517,219 A * 5/1996 Uchida ..... 347/24
5,627,574 A * 5/1997 Fahy ..... 347/33
5,659,341 A * 8/1997 Kinas ..... 347/33
5,680,162 A * 10/1997 Taylor et al. ..... 347/35
5,742,303 A 4/1998 Taylor et al. ..... 347/36
5,839,595 A 11/1998 Ujita ..... 220/4.21
5,847,728 A * 12/1998 Lee ..... 347/33
5,946,009 A * 8/1999 Youn ..... 347/32
5,980,018 A 11/1999 Taylor et al. ..... 347/31
5,997,126 A * 12/1999 Nguyen et al. ..... 347/22
5,997,128 A * 12/1999 Lou et al. ..... 347/33
6,042,216 A * 3/2000 Garcia et al. ..... 347/29
6,102,533 A 8/2000 Nozawa et al. ..... 347/86
6,116,719 A 9/2000 Maza ..... 347/22
6,132,026 A 10/2000 Taylor et al. ..... 347/32
6,152,555 A 11/2000 Nozawa et al. ..... 347/49
6,168,257 B1 * 1/2001 Aldrich ..... 347/32
6,168,258 B1 1/2001 Lou et al. ..... 347/33
6,203,135 B1 * 3/2001 Murcia et al. ..... 347/22
6,234,626 B1 5/2001 Axtell et al. ..... 347/108
6,264,322 B1 7/2001 Axtell et al. ..... 347/108
6,315,386 B1 * 11/2001 Bailey et al. ..... 347/22
6,318,838 B1 * 11/2001 Anderson et al. ..... 347/36
6,322,196 B1 * 11/2001 Lim ..... 347/35
6,398,338 B1 * 6/2002 Berg et al. ..... 347/32
6,402,290 B1 * 6/2002 Johnson et al. ..... 347/32
6,464,327 B1 * 10/2002 Eckard et al. ..... 347/33
6,659,585 B2 * 12/2003 Urrutia et al. ..... 347/22
6,682,167 B2 * 1/2004 Davis et al. ..... 347/32
2002/0158941 A1 * 10/2002 Vega et al. ..... 347/35

* cited by examiner

*Primary Examiner*—Stephen D. Meier
*Assistant Examiner*—Leonard Liang
(74) *Attorney, Agent, or Firm*—Ronald K. Aust

(57) ABSTRACT

An ink jet printer includes a printhead and a maintenance station. The maintenance station includes a fixed support housing, a sled and a chimney. The sled is supported on the support housing and is movable relative to the support housing in both a horizontal direction and a vertical direction. The chimney receives ink spit from the printhead. The chimney has a fixed vertical position relative to the printhead and is horizontally movable in response to movement of the sled.

31 Claims, 6 Drawing Sheets

CHIMNEY FOR PREVENTING INK MISTING

BACKGROUND OF THE INVENTION

1. Field of the Invention

The present invention relates to an ink jet printer, and, more particularly, to a maintenance or service station for an ink jet printer.

2. Description of the Related Art

Current ink jet printhead technology fires very tiny ink droplets in order to provide the best print quality. The ink droplets are so small that if they do not impact a surface within a short distance of leaving the nozzles, they tend to drift away in a cloud of mist. During printing, this is not an issue because the paper is only about 1.00 mm to 1.25 mm away. However during the spitting performed in a maintenance cycle, there is a much greater distance to cover before the ink reaches the features designed to receive them on the maintenance sled. In this empty space, an ink mist cloud can form and float into other areas of the printer. Over time, this ink misting collects on the inside of the covers, some even escaping through holes in the covers to form splotches on the inside of the covers.

It is known to attach a rotating drum 20 (FIG. 1) to a sled 22 in order to give the ink a place to collect. The drum turns so that the ink drips off into the ink well and a clean surface is positioned for the next spit. It is also possible to disable the mechanism for the drum rotation, and to allow the ink to drip around the sides as it collects on the top. It is also possible to place a drum 24 (FIG. 2) between a printhead cap 26 and a printhead wiper 28 on a sled 30. Drum 24 provides a curved surface, concave down, that the ink strikes and then runs off, to be collected beneath the drum for evaporative dispersion.

It is also known to provide the maintenance sled with a chimney into which the spit ink can be directed. The chimney is intended to surround the ink mist cloud and thereby prevent its movement into other areas of the printer. The ink mist collects on the inside walls of the chimney and flows down toward an ink collection area underneath the sled. Known chimneys are affixed to the sled, as are rotating and stationary drums. The chimney and drum must be designed such that, as the sled moves upward, the top of the chimney or drum does not physically contact or otherwise interfere with the printhead. Thus, the top of the chimney or drum must be maintained at a distance during the spitting of the printhead that is equal to the vertical distance the sled travels before other maintenance functions are performed, such as capping. This is illustrated in FIG. 3, wherein a gap 32 between a chimney 34 and a printhead 36 is maintained during the spitting operation so that chimney 34 does not interfere with printhead 36 during the capping operation (FIG. 4). A problem with this implementation of the chimney or drum is that with this rather large gap, the mist cloud is not completely captured in the chimney or collected by the drum, and can escape the maintenance area.

What is needed in the art is a device for preventing the drifting of a cloud of ink mist after a spitting operation in a maintenance station.

SUMMARY OF THE INVENTION

The present invention provides a maintenance station chimney that moves horizontally with the maintenance sled, but does not vertically rise along with the maintenance sled during capping and wiping operations. Thus, a minimal gap can be achieved between the chimney and the printhead during the spitting operation without the chimney interfering with the printhead during the capping and wiping operations. Because the chimney slides vertically with respect to the sled, and rides in horizontal tracks in the housing, it can remain very close to the nozzle plate in terms of vertical separation.

Since the chimney is so close to the nozzle plate, almost the entire mist cloud will be captured inside the chimney. However, because the carrier moves away after spitting while the mist cloud is still present inside the chimney, the air currents produced by the carrier movement can create a suction that pulls the mist cloud out of the chimney. To prevent this situation, the mist cloud must adhere to a capturing medium inside the chimney. This medium could be any of several varieties of porous filler materials such as foam or felt. The capturing medium must be dense enough for the mist to quickly adhere to, but it must remain porous enough for the collected ink to drain away easily.

The invention comprises, in one form thereof, an ink jet printer including a printhead and a maintenance station. The maintenance station includes a fixed support housing, a sled, a chimney, and a capturing medium. The sled is supported on the support housing and is movable relative to the support housing in both a horizontal direction and a vertical direction. The chimney receives ink spit from the printhead, which is collected in the capturing medium located inside the chimney. The chimney has a fixed vertical position relative to the printhead and is horizontally movable in response to movement of the sled.

An advantage of the present invention is that, since the chimney is very close to the nozzle plate of the printhead during the spitting operation, the ink mist cloud is fully enclosed and adheres to the capturing medium, thereby preventing mist from escaping the maintenance area.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
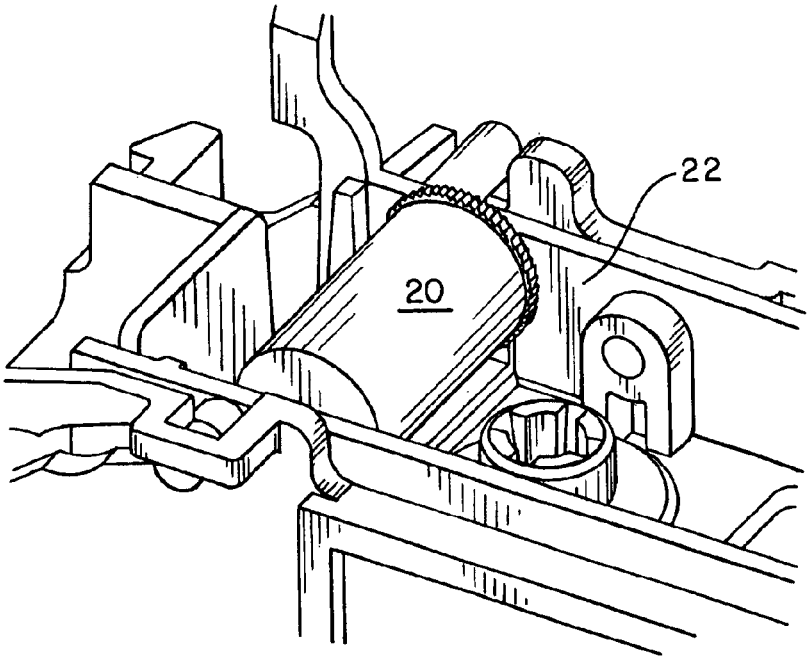
PRIOR ART Fig. 1
FIG. 1 is a fragmentary, perspective view of a known maintenance sled.
Figure 2:
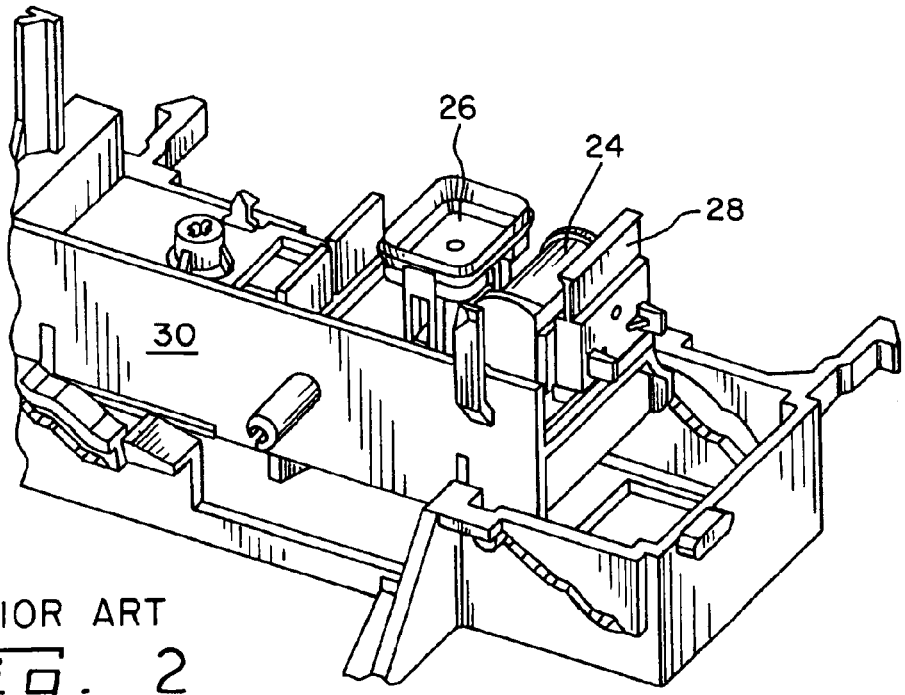
PRIOR ART Fig. 2
FIG. 2 is a fragmentary, perspective view of a known maintenance station.
Figure 3:
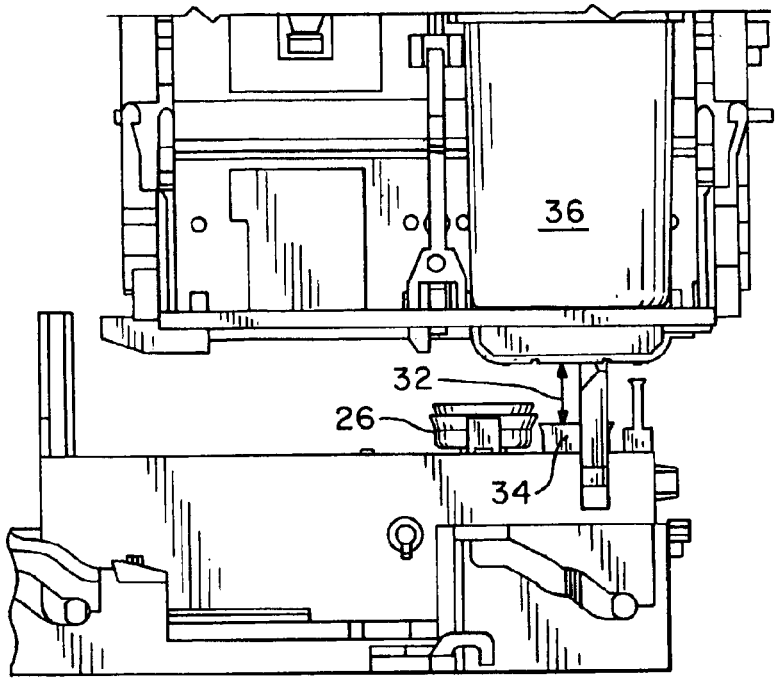
PRIOR ART Fig. 3
FIG. 3 is a fragmentary, side view of another known maintenance station in association with a printhead during a spitting operation.
Figure 4:
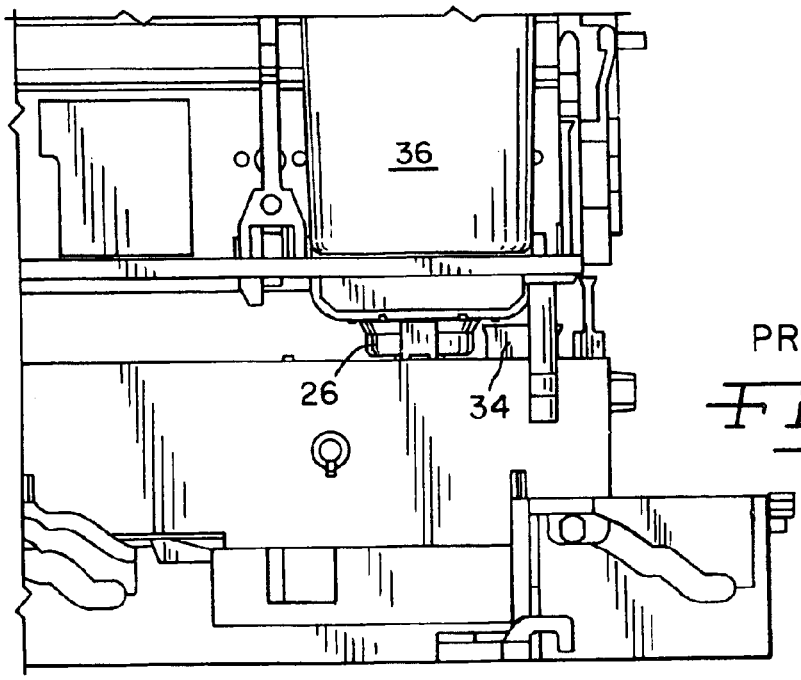
PRIOR ART Fig. 4
FIG. 4 is a fragmentary, side view of the known maintenance station of FIG. 3 in association with a printhead during a capping operation.
Figure 5:
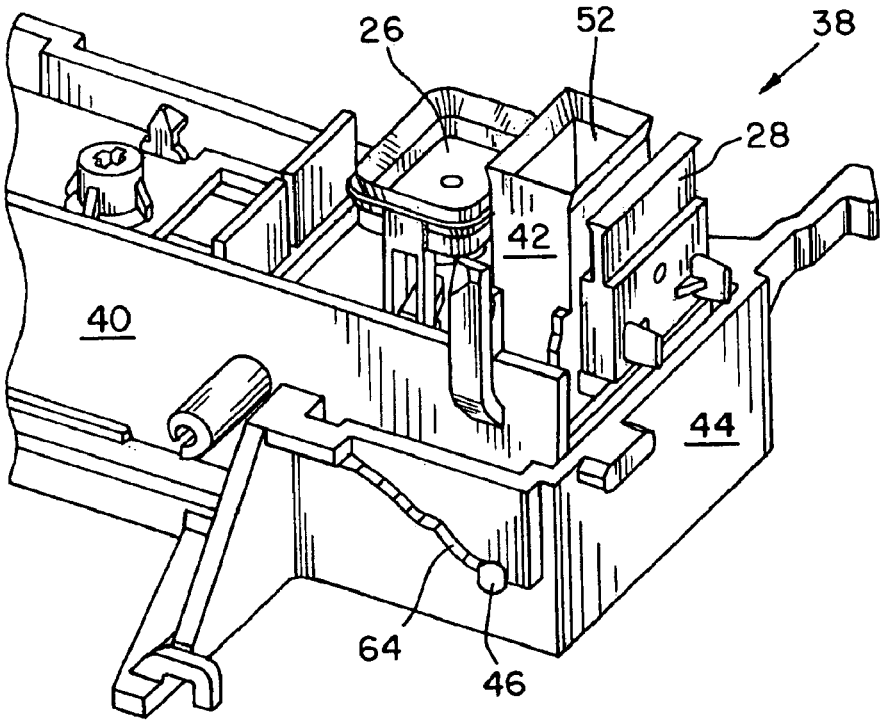
FIG. 5 is a fragmentary, perspective view of one embodiment of the maintenance station of the present invention.

Referring now to FIG. 5, there is shown one embodiment of a service station 38 of the present invention, including a movable sled 40, a printhead cap 26, a spit containment device in the form of a slidable plastic chimney 42, a printhead wiper 28, and a fixed support housing or base 44.

Figure 6:
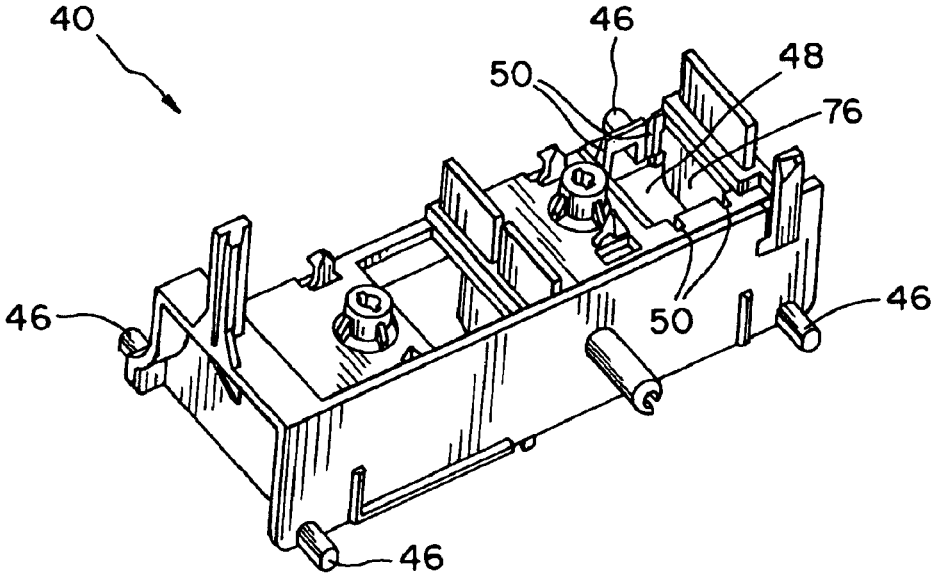
FIG. 6 is a perspective view of the sled of FIG. 5.

Sled 40 includes four pins 46 (FIG. 6) and an opening 48 for receiving chimney 42. Opening 48 has four vertical slots 50. Sled 40 is movable relative to support housing 44 in both a horizontal direction and a vertical direction. Sled 40 is attached to each of printhead cap 26 and printhead wiper 28.

Figure 7:
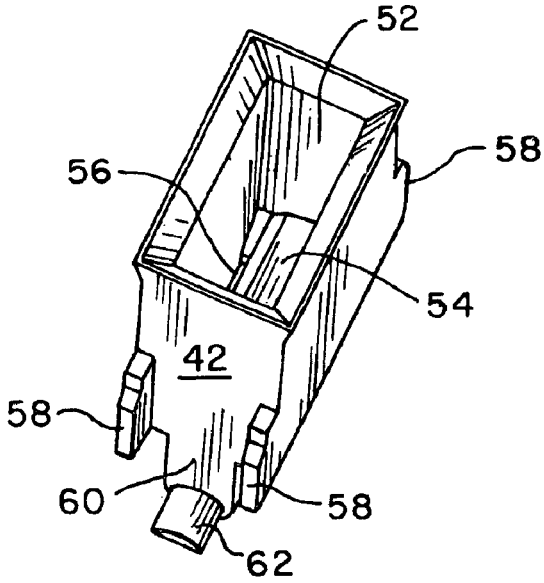
FIG. 7 is a perspective view of the chimney of FIG. 5.
Figure 8:
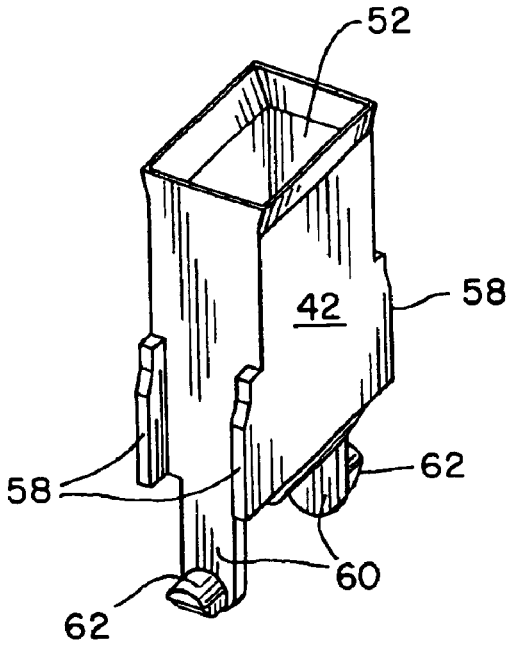
FIG. 8 is another perspective view of the chimney of FIG. 5.

Chimney 42 has a channel 52 with a curved surface 54 (FIG. 7) at the bottom. On each side of curved surface 54 is a respective through slot 56. Chimney 42 also has four vertical ribs 58 and two opposing vertical posts 60 (FIG. 8). Each rib 58 is received in a respective one of slots 50 in sled 40. At a distal end of each post 60 is a horizontal projection 62. Chimney 42 has a fixed vertical position and is horizontally movable in response to movement of sled 40. Chimney 42 is disposed between and adjacent to each of printhead cap 26 and printhead wiper 28.

Figure 9:
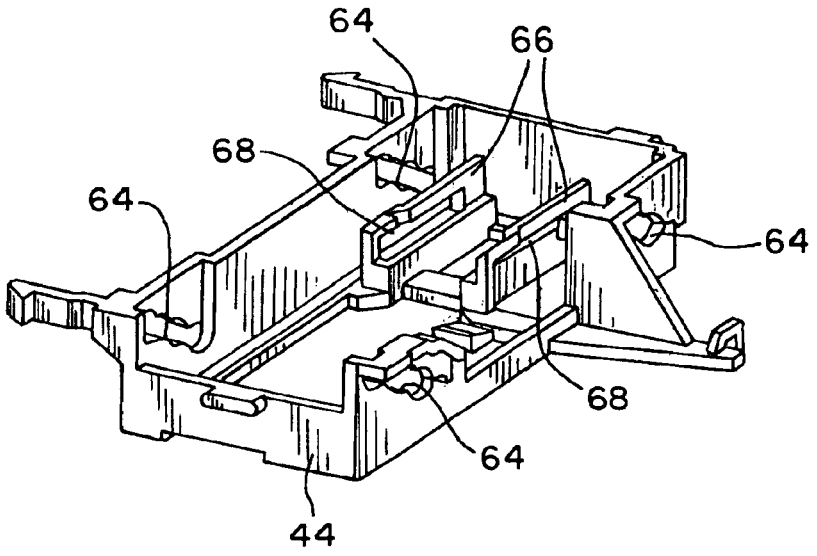
FIG. 9 is a perspective view of the housing of FIG. 5.

Housing 44 is fixed to the frame (not shown) of the printer and includes four ramps 64 along the lengths of which pins 46 of sled 40 traverse. Housing 44 also includes a pair of horizontal, parallel rails 66 (FIG. 9) each having a respective horizontal slot 68 for receiving a projection 62 of a respective post 60. Thus, housing 44 is coupled to chimney 42, thereby preventing chimney 42 from moving in the vertical direction relative to housing 44. Each slot 68 is parallel to the horizontal direction in which sled 40 is movable. Housing 44 supports sled 40.

Figure 10:
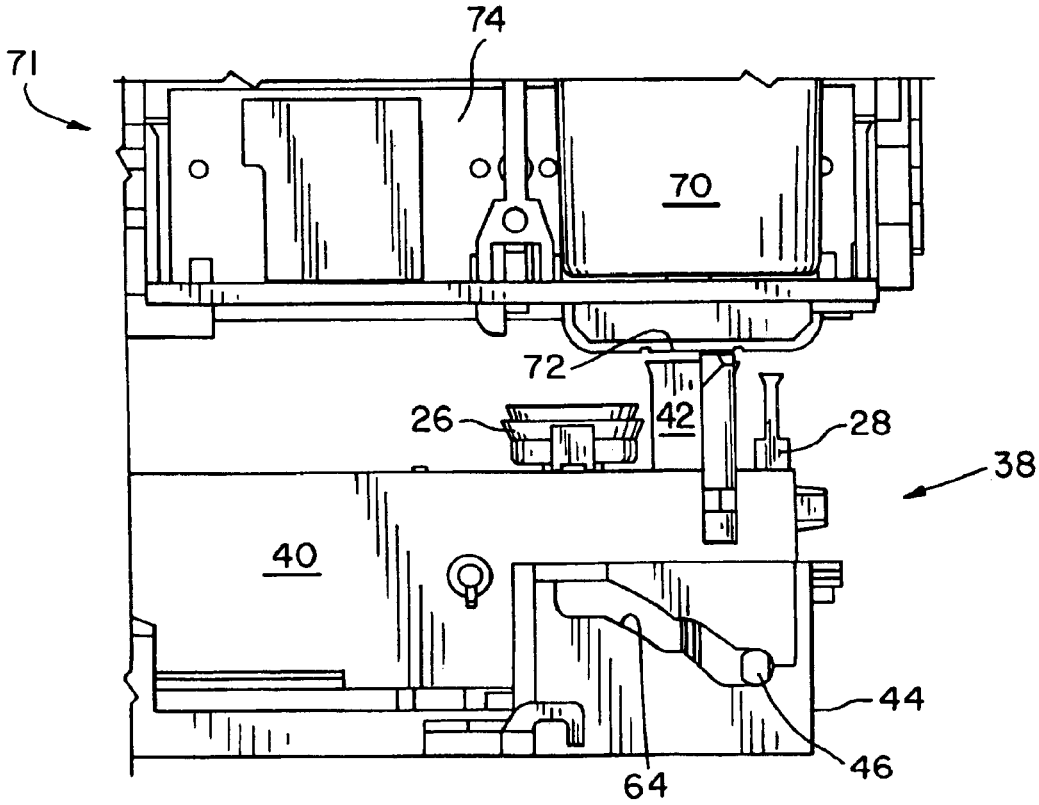
FIG. 10 is a fragmentary, side view of the maintenance station of FIG. 5 in association with a printhead during a spitting operation.

In operation, chimney 42 is disposed beneath a color printhead 70 (FIG. 10) of printer 71 during a spitting function. Chimney 42 has a fixed vertical position relative to printhead 70. At this time, maintenance sled 22 is at its lowest position. The height of chimney 42 allows it to reach very close to printhead 70, with a clearance therebetween of approximately 1.0 mm. As the ink is spit from the nozzles of printhead 70, an ink mist cloud is formed just below nozzle plate 72. Since chimney 42 surrounds the area of nozzle plate 72, this cloud is contained within chimney 42. Immediately after spitting, a carrier 74 quickly moves printhead 70 into the print zone to begin printing. In known printers, the air currents created by the movement of the carrier suck the ink mist cloud out into the open area of the printer, where it soon comes to rest on the covers of the printer. In the present invention, however, the chimney walls surround the ink mist cloud, and the entrained air cannot draw nearly as much ink mist out into the open. Most of the ink mist impinges upon and is received by the inside surfaces of the walls of chimney 42. The ink then flows down through through slots 56 and drains down into an ink well or felt pad in the frame of the printer.

Figure 11:
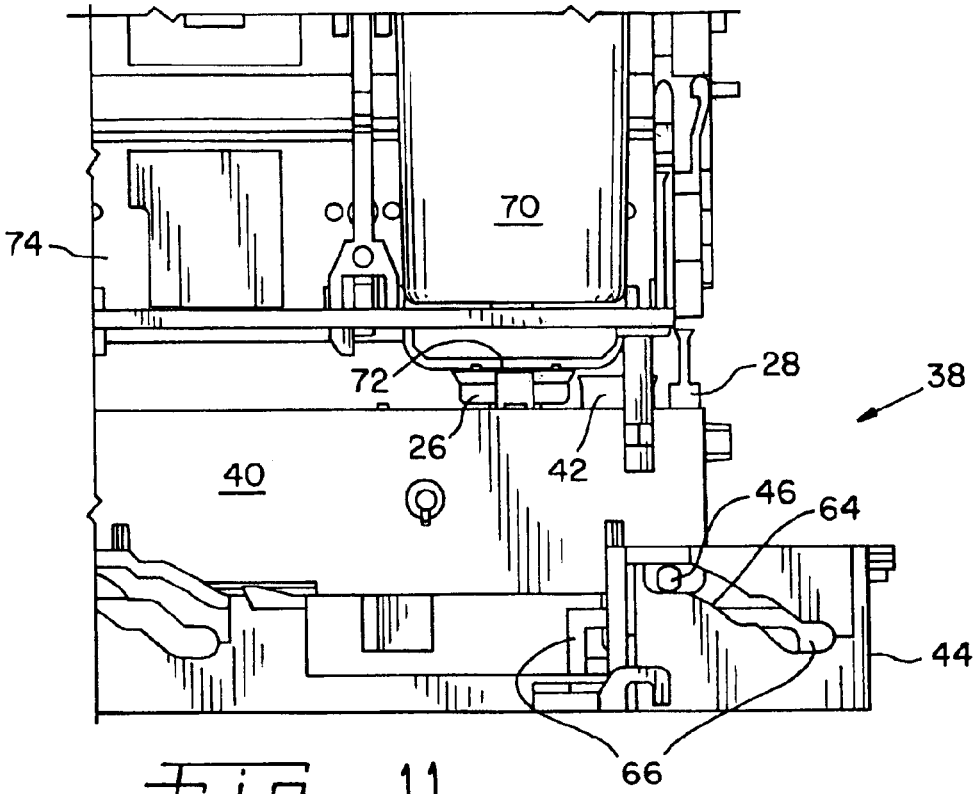
FIG. 11 is a fragmentary, side view of the maintenance station of FIG. 5 in association with a printhead during a capping operation.
Figure 12:
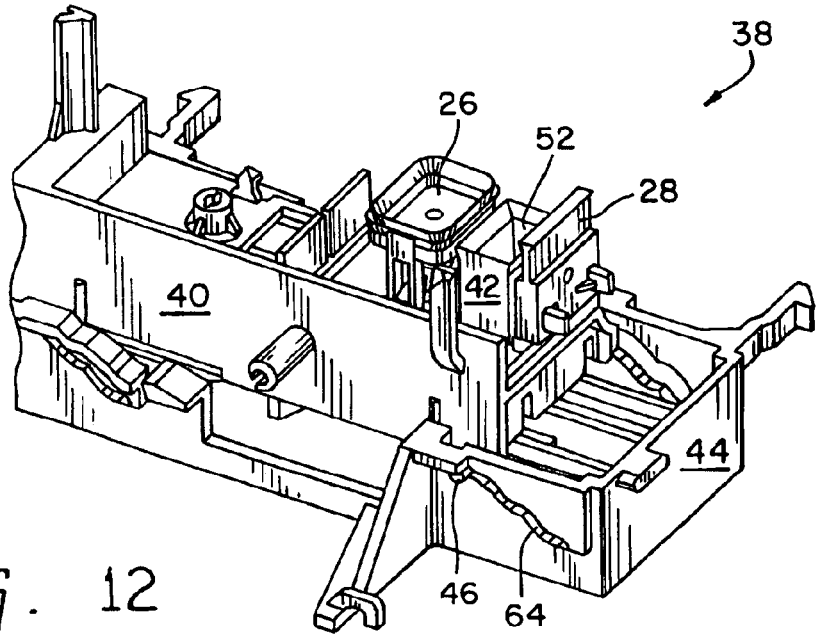
FIG. 12 is a fragmentary, perspective view of the maintenance station of FIG. 5 during a capping operation.

When carrier 74 comes back to the home position, it contacts sled 40, which begins to slide up ramps 64 in housing 44. As sled 40 moves horizontally and vertically upward relative to housing 44, chimney 42 slides horizontally along rails 66. Sled 40 includes a vertical surface 76, facing opening 48, which engages chimney 42 and pushes chimney 42 along rails 66. Rails 66 retain chimney 42 at a constant vertical position as projections 62 of posts 60 slide horizontally along slots 68 of rails 66. Sled 40 is free to slide vertically relative to chimney 42 by virtue of the four slots 50 of sled 40 sliding over the four ribs 58 of chimney 42. Thus, as sled 40 moves to the left and upward, chimney 42 just translates to the left, remaining in the same vertical position with respect to printhead 70, as illustrated in FIGS. 11 and 12. By sliding vertically relative to sled 40, chimney 42 is able to remain clear of printhead 70.

Grease can be applied to rails 66 and slots 50 to enable chimney 42 to slide smoothly and resist wear. Thus, chimney 42 does not impart too much friction, which could cause binding in the maintenance operation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A maintenance station for a printer, comprising:

a fixed support housing;

a sled supported on said support housing and being movable relative to said support housing in both a horizontal direction and a vertical direction; and a spit containment device configured to receive spit ink, said spit containment device having a fixed vertical position and being horizontally movable in response to movement of said sled.

2. The maintenance station of claim 1, wherein said spit containment device comprises a chimney.

3. The maintenance station of claim 2, wherein said sled includes an opening, said chimney being received in said opening.

4. The maintenance station of claim 3, wherein said opening includes at least one substantially vertical slot, said chimney having at least one substantially vertical rib, each said rib being received in a corresponding said vertical slot.

5. The maintenance station of claim 2, further comprising at least one of a printhead cap and a printhead wiper attached to said sled.

6. The maintenance station of claim 5, wherein said chimney is disposed adjacent to said at least one of a printhead cap and a printhead wiper.

7. A maintenance station for a printer, comprising:

a fixed support housing;

a sled supported on said support housing and being movable relative to said support housing in both a horizontal direction and a vertical direction; and a spit containment device conflaured to receive spit ink, said spit containment device havina a fixed vertical position and being horizontally movable in response to movement of said sled.

wherein said spit containment device comprises a chimney; and wherein said support housing is coupled to said chimney.

8. The maintenance station of claim 7, wherein said coupling of said support housing to said chimney prevents said chimney from moving in the vertical direction relative to said support housing.

9. The maintenance station of claim 8, wherein said support housing includes at least one substantially horizontal slot, said chimney having at least one projection received in said at least one slot.

10. The maintenance station of claim 9, wherein said slot is substantially parallel to the horizontal direction.

11. An ink jet printer, comprising:

a printhead; and a maintenance station including:

a fixed support housing;

a sled supported on said support housing and being movable relative to said support housing in both a horizontal direction and a vertical direction; and a spit containment device configured to receive ink spit from said printhead, said spit containment device having a fixed vertical position relative to said printhead and being horizontally movable in response to movement of said sled.

12. The printer of claim 11, wherein said spit containment device comprises a chimney.

13. The printer of claim 12, wherein said sled includes an opening, said chimney being received in said opening.

14. The printer of claim 13, wherein said opening includes at least one substantially vertical slot, said chimney having at least one substantially vertical rib, each said rib being received in a corresponding said vertical slot.

15. The printer of claim 12, further comprising at least one of a printhead cap and a printhead wiper attached to said sled.

16. The printer of claim 15, wherein said chimney is disposed adjacent to said at least one of a printhead cap and a printhead wiper.

17. The printer of claim 12, wherein a gap between said chimney and said printhead is not greater than approximately 1.0 mm when said chimney receives the ink spit from said printhead.

18. An ink jet printer, comprising:

a printhead; and a maintenance station including:

a fixed support housing;

a sled supported on said support housing and being movable relative to said support housing in both a horizontal direction and a vertical direction; and a spit containment device configured to receive ink spit from said printhead, said spit containment device having a fixed vertical position relative to said printhead and being horizontally movable in response to movement of said sled, wherein said spit containment device comprises a chimney; and wherein said support housing is coupled to said chimney.

19. The printer of claim 18, wherein said coupling of said support housing to said chimney prevents said chimney from moving in the vertical direction relative to said support housing.

20. The printer of claim 19, wherein said support housing includes at least one substantially horizontal slot, said chimney having at least one projection received in said at least one slot.

21. The printer of claim 20, wherein said slot is substantially parallel to the horizontal direction.

22. A maintenance station for a printer, comprising:

a fixed support housing;

a sled supported on said support housing and being movable relative to said support housing in both a horizontal direction and a vertical direction; and a spit containment device configured to receive spit ink, said spit containment device having a fixed vertical position and being horizontally movable relative to said support housing.

23. The maintenance station of claim 22, wherein said spit containment device comprises a chimney.

24. The maintenance station of claim 23, wherein said sled includes an opening, said chimney being received in said opening.

25. The maintenance station of claim 24, wherein said opening includes at least one substantially vertical slot, said chimney having at least one substantially vertical rib, each said rib being received in a corresponding said vertical slot.

26. The maintenance station of claim 23, further comprising at least one of a printhead cap and a printhead wiper attached to said sled.

27. The maintenance station of claim 26, wherein said chimney is disposed adjacent to said at least one of a printhead cap and a printhead wiper.

28. A maintenance station for a printer, comprising:

a fixed support housing;

a sled supported on said support housing and being movable relative to said support housing in both a horizontal direction and a vertical direction; and a spit containment device configured to receive spit ink, said spit containment device having a fixed vertical position and being horizontally movable relative to said support housing, wherein said spit containment device comprises a chimney; and wherein said support housing is coupled to said chimney.

29. The maintenance station of claim 24, wherein said coupling of said support housing to said chimney prevents said chimney from moving in the vertical direction relative to said support housing.

30. The maintenance station of claim 29, wherein said support housing includes at least one substantially horizontal slot, said chimney having at least one projection received in said at least one slot.

31. The maintenance station of claim 30, wherein said slot is substantially parallel to the horizontal direction.

* * * * *